US006587400B1

(12) United States Patent
Line

(10) Patent No.: US 6,587,400 B1
(45) Date of Patent: Jul. 1, 2003

(54) BATTERY-POWERED WRISTWATCH

(76) Inventor: Henry Line, 191 Ridge Dr., Carlisle, PA (US) 17013

( * ) Notice: Subject to any disclaimer, the term of this patent is extended or adjusted under 35 U.S.C. 154(b) by 0 days.

(21) Appl. No.: 10/068,063

(22) Filed: Feb. 5, 2002

(51) Int. Cl.[7] ..... G04B 37/00; G04B 1/00; G04C 23/02; A44C 5/00

(52) U.S. Cl. ..... 368/88; 368/204; 368/281

(58) Field of Search ..... 368/88, 203, 204, 368/276, 281, 282, 309

(56) References Cited

U.S. PATENT DOCUMENTS

| | | | | | |
|---|---|---|---|---|---|
| 3,032,651 | A | | 5/1962 | Gisiger-Stahli et al. | 250/14 |
| 3,729,923 | A | | 5/1973 | Brigliano et al. | 58/50 R |
| 3,783,604 | A | | 1/1974 | Florent et al. | 58/50 R |
| 3,942,316 | A | * | 3/1976 | Van Haaften | |
| 3,971,206 | A | | 7/1976 | Martino | 58/88 R |
| 3,973,706 | A | | 8/1976 | Boyce et al. | 224/4 D |
| 3,975,899 | A | | 8/1976 | Haber | 58/88 R |
| 3,977,176 | A | * | 8/1976 | Murakami et al. | |
| 4,023,347 | A | | 5/1977 | Haber | 58/88 R |
| 4,095,412 | A | * | 6/1978 | Burke | |
| 4,103,483 | A | * | 8/1978 | Riley | |
| 4,141,074 | A | | 2/1979 | Popper | 364/705 |
| 4,390,288 | A | | 6/1983 | Arnoux | 368/276 |
| 4,407,590 | A | * | 10/1983 | Ohno et al. | 368/204 |
| 4,412,751 | A | * | 11/1983 | Jeannet et al. | 368/276 |
| 4,417,819 | A | | 11/1983 | Migeon | 368/67 |
| 4,488,345 | A | * | 12/1984 | Muller et al. | 368/204 |
| 4,629,329 | A | | 12/1986 | Komiyama | 368/10 |
| 5,181,192 | A | * | 1/1993 | Paratte et al. | 368/282 |
| 5,712,553 | A | * | 1/1998 | Hallberg | 320/15 |
| 5,872,744 | A | | 2/1999 | Taylor | 368/13 |

* cited by examiner

*Primary Examiner*—Vit Miska
(74) *Attorney, Agent, or Firm*—Hooker & Habib, P.C.

(57) ABSTRACT

A wristwatch has a rigid watchcase and opposed pairs of lugs for mounting a wristband. The watchcase houses a battery-powered quartz watch movement and includes a number of battery compartments outside of the watch movement for batteries to power the watch movement. Each battery compartment has a door that enables changing the battery in the compartment without exposing the watch movement to the outside environment. The lugs are integrally attached to the doors and provide convenient handles for opening and closing the doors.

20 Claims, 3 Drawing Sheets

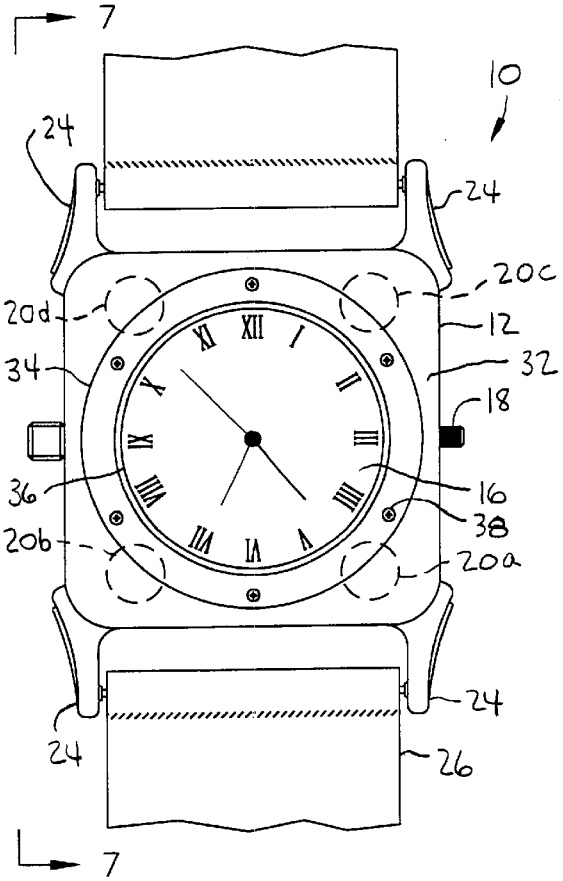
FIG. 1
FIG. 2
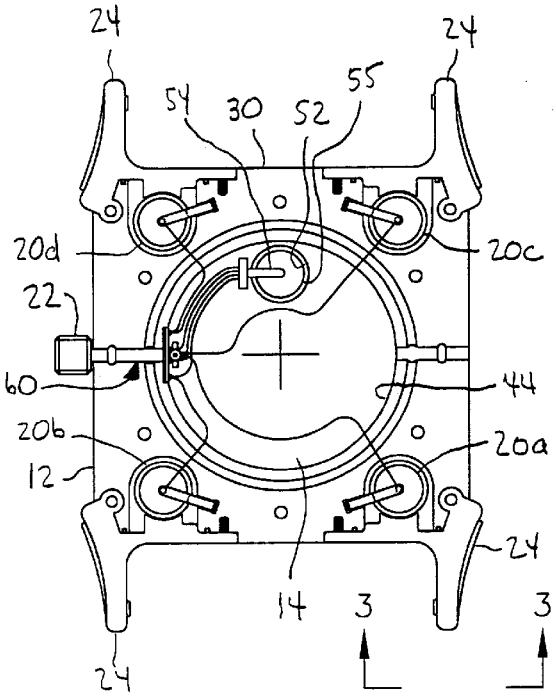
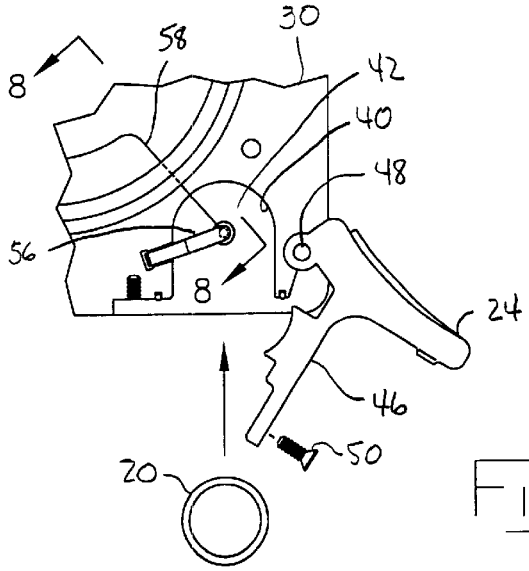
FIG. 4
FIG. 3
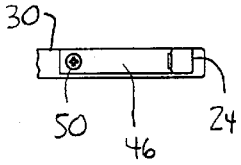

BATTERY-POWERED WRISTWATCH

FIELD OF THE INVENTION

The invention relates to battery-powered timepieces, and particularly to battery-powered wristwatches.

BACKGROUND OF THE INVENTION

Battery-powered wristwatches have become popular because of their accurate timekeeping, dependable service, and convenience. A conventional battery-powered wristwatch has a low-cost quartz watch movement housed within a watchcase. The watch movement includes a battery compartment containing a single battery to power the watch movement.

Although conventional wristwatches provide good service, there is room for improvement. To replace the battery, the back of the watchcase must be removed to gain access to the battery compartment. In virtually all currently produced watches this directly exposes the watch movement to the outside environment and enables pollutants and other contaminants to reach sensitive watch movement components with deleterious effects.

In addition it is well known that watch batteries, like many larger dry-cell batteries are not immune to leakage and when this happens the movement is often damaged. This is true even for the cells in quartz watches that have self-charging mechanisms.

Also it has become well established that when many watch owners who are inexperienced in handling watches attempt to install a battery they often inadvertently touch and damage delicate movement parts. This is also true of under-trained department store clerks and the like.

Furthermore, it is desirable to extend the operating life of the wristwatch between battery changes. It is known to provide batteries in external battery compartments outside of the watchcase to extend the operating life of the watch. However, the external battery compartments detract from the appearance of the watch and require complicated electrical connections extending between the external battery compartments and the watch movement.

Thus there is a need for an improved battery-powered wristwatch. The wristwatch should enable battery replacement without exposing the watch movement to the outside environment while providing longer operating life between battery changes without external battery compartments, and the movement needs to be isolated from the battery.

SUMMARY OF THE INVENTION

The invention is an improved battery-powered wristwatch that enables battery replacement without exposing the watch movement to the outside environment. The wristwatch can include two or more batteries within the watchcase, enabling longer operating life between battery changes without the need for external battery compartments.

A wristwatch in accordance with the present invention includes a rigid watchcase comprising an exterior portion defining an interior case compartment. A battery-powered watch movement housed within the case compartment is connected to a display, typically a pair of hands indicating the time. The watchcase includes an interior wall in the case compartment cooperating with the exterior portion of the case to define a battery compartment within the case compartment. The watch movement is outside of the battery compartment.

Electrical connections in the case compartment extend from the battery compartment to the watch movement to transmit electrical power from a battery in the battery compartment to the watch movement. A battery compartment door on the exterior portion of the watchcase faces the battery compartment and is movable between a closed position wherein the battery compartment is closed to retain a battery in the battery compartment and an opened position wherein the battery compartment is open to the outside environment. When changing the battery only the battery compartment is directly exposed to the outside environment.

In preferred embodiments of the present invention two or more battery compartments are defined within the watchcase. Each battery compartment has its own battery compartment door. In a particularly preferred embodiment the watchcase has four battery compartments, each battery compartment adjacent a lug or horn for mounting a conventional wristband. Each lug is an integral part of and extends from a respective battery compartment door to form a convenient handle for opening and closing the door.

Noteworthy of mention is the fact that, unlike mechanical spring driven movements, the smaller quartz movements have virtually the same degree of accuracy as the larger quartz movements. Thus, even with four batteries, the overall size of the improved watch in accordance with the present invention needs to be no larger than an average size conventional wristwatch.

Other objects and features of the invention will become apparent as the description proceeds, especially when taken in conjunction with the accompanying three drawing sheets illustrating one embodiment of the invention.

BRIEF DESCRIPTION OF THE DRAWINGS

FIG. 1 is a top view of a wristwatch in accordance with the present invention;

FIG. 2 is a view similar to FIG. 1 but with the watchband and watchcase bezel removed;

FIG. 3 is a partial side view taken along Line 3—3 of FIG. 2;

FIG. 4 is an enlarged top view of a battery compartment of the watchcase shown in FIG. 2, illustrating insertion of a battery into the open battery compartment;

DESCRIPTION OF THE PREFERRED EMBODIMENT

Figure 5:
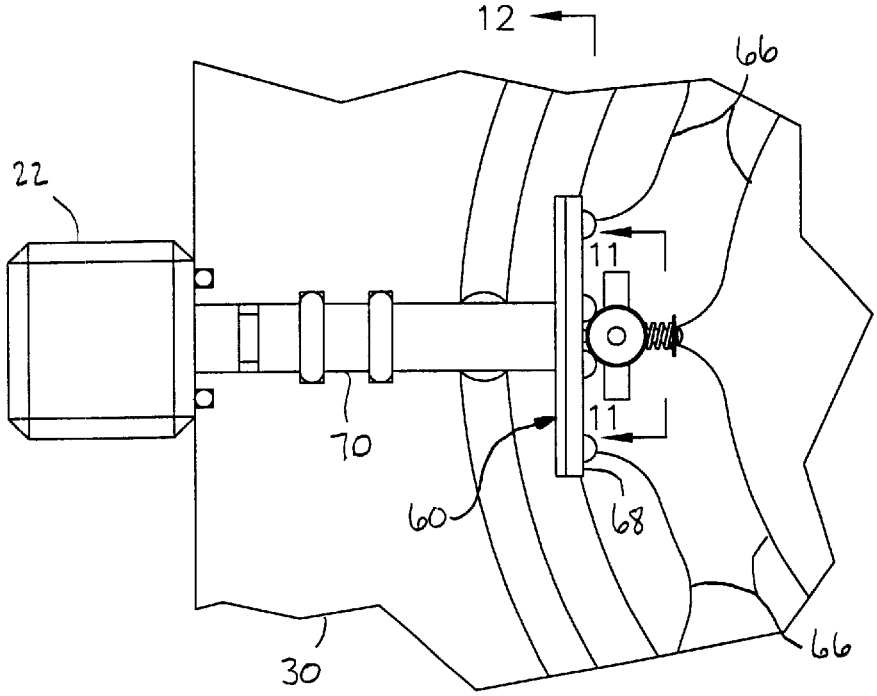
FIG. 5 is an enlarged top view of a rotary switch in the watchcase shown in FIG. 2, the switch connected to a switch crown that enables a user to select which battery powers the watch movement.
Figure 6:
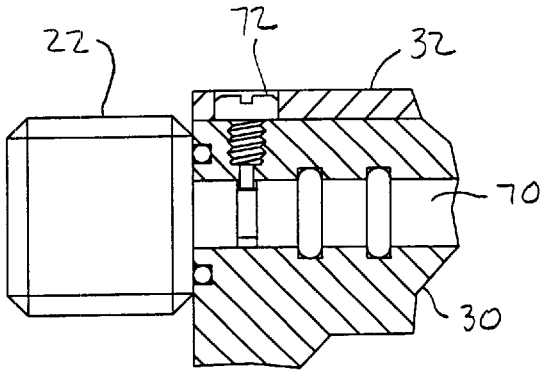
FIG. 6 is a vertical sectional view taken along the longitudinal axis of the switch stem connecting the rotary switch and switch crown.

FIGS. 1–12 illustrate a wristwatch 10 in accordance with the present invention. The watch 10 includes a rigid watchcase 12 housing a battery-powered quartz watch movement 14 in the case 12. The watch movement 14 is conventional and so will not be described in detail. The watch movement 14 drives an analog display 16 to indicate the time. The display 16 includes hour, minute and second hands located above a watch dial. The watch movement 14 includes a control stem that extends outside of the watchcase to a control crown 18 for setting and otherwise controlling the watch movement such as the setting of a day-date mechanism (not shown).

Four batteries 20*a*, 20*b*, 20*c* and 20*d* (shown in phantom in FIG. 1) within the watchcase 12 provide power to the watch movement 14. Each battery 20 can be user-selected to energize the watch movement via a switch crown 22 on the side of the case. The switch crown 22 is connected to a switch apparatus that opens and closes electrical connections between the batteries and electric contacts on the watch movement 14 as will be described in greater detail below.

Pairs of horns or lugs 24 are located on opposite ends of the watchcase 12. Each pair of lugs 24 extend outwardly away from the case 12 and are configured to hold a respective spring bar of a conventional watchband 26 between them in a known manner.

Figure 7:
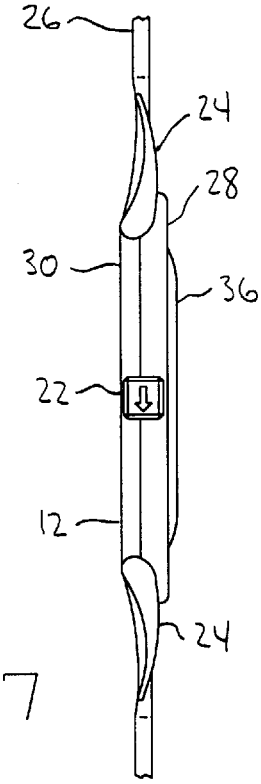
FIG. 7 is a side view of the watchcase taken along Line 1—1 of FIG. 1.
Figure 8:
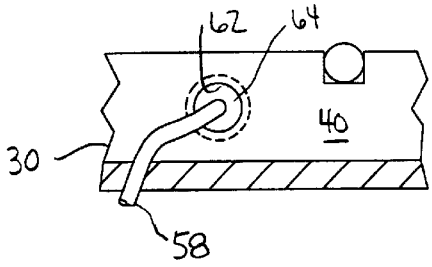
FIG. 8 is a partial section view taken along line 8—8 of FIG. 4.

The watchcase 12 is formed from a bezel 28 on the top or upper side of the watchcase and a metal lower case member 30 on the back or lower side of the watchcase 12, with outer edges of the bezel 28 and case member 30 joining the upper and lower sides of the watchcase 12 (see FIG. 7). The bezel 28 includes a bezel case member 32, bezel retaining ring 34 and transparent crystal 36. The retaining ring 34 is secured to the bezel member by screws 38 that extend through the ring 34 and case member 32 and into threaded holes formed in the lower case member 30 to clamp the bezel 28 and lower case member 30 together. Other watchcase constructions are known and can be readily adapted for use with the present invention.

The bezel 28 and lower case member 30 together define an interior case compartment for housing the watch movement 14 and batteries 20. FIG. 2 illustrates the watchcase 12 with the bezel 28 removed to view the interior of the case compartment. The lower case member 30 has four sidewalls 40 formed on the upper side of the case member, each sidewall 40 defining a portion of a respective battery compartment 42. Pairs of sidewalls 40 are formed on opposite ends of the watchcase, each sidewall 40 adjacent a respective lug 24. A central sidewall 44 defines a watch movement compartment spaced from the battery compartments, with the watch movement 14 retained in the watch movement compartment. The watch movement and battery compartments are open at the upper side of the lower case member 30 and extend only partway through the thickness of the case member 30. The bezel 28 and lower case member 30 form the roof and floor respectively of the watch and battery compartments.

Each battery compartment 42 is defined by similar construction and so only one battery compartment will be described in detail. The sidewall 40 defines a cavity at the outer edge of the lower case member 30. A battery compartment door 46 is movably mounted on the edge of the lower case member 30 adjacent the battery compartment 42 to open and close the battery compartment. A hinge or pivot axle 48 attached to the lower case member 30 pivotally connects the door 46 to the lower case member 30. The pivot axle 48 defines an axis of rotation of the door.

The door 46 is movable between a closed position shown in FIG. 2 wherein the battery compartment is closed and an opened position shown in FIG. 4 wherein the battery compartment is open for inserting or removing a battery 20. The door 46 forms a portion of the sidewall defining the battery compartment 42 when the door is closed. A screw 50 normally holds the door tightly closed against the lower case member 30 as shown in FIG. 3.

In the illustrated embodiment each lug 24 is mounted on a respective door 46. The lug 24 projects outwardly from the door and forms a convenient door handle to open and close the compartment door 46 when replacing a battery.

Electrical connections within the watchcase compartment extend from each battery compartment 42 to electrically connect the batteries 20 to the watch movement 14. In the illustrated embodiment the watch movement 14 is a low cost, readily available movement originally intended to be operated by a single self-contained battery like a battery 20. The watch movement 14 includes its own battery compartment 52 and a blade contact 54 positioned over the battery compartment 52. A battery terminal of a battery inserted in the battery compartment 52 would contact the blade contact 54. The blade contact 54 is wired to a conventional drive mechanism (not shown) in the watch movement 14 that drives the time display. The other battery terminal would contact the floor of the battery compartment 52 formed by the lower case member 30. The case member 30 is metallic and is intended to ground the other battery terminal and form the return conduction path from the drive mechanism to such other battery terminal.

The wrist watch 10 is powered by the watch batteries 20 and does not include a battery in the watch movement battery compartment 52. However, the electrical connections use the blade contact 54 as a common contact to power the watch movement as described below. The lower case member 30 acts as a ground forming the return conduction path from the watch movement 14 to each of the batteries 20. A plug or dummy battery 55 in the watch movement battery case compartment 52 engages the blade contact 54.

The dummy battery 55 has the same configuration and dimensions as a conventional battery intended to power the watch movement 14. The dummy battery 55 includes terminals or terminal areas corresponding to the positive and negative terminals of a conventional battery. An insulator separates the terminals of the dummy battery 55. The dummy battery 55 has no interior chemicals, that if present, would produce an electrical current. The positive terminal of the dummy battery 55 is permanently attached to the lower case member 30. When the watch movement is inserted into the case, the blade contact 54 contacts the negative terminal of the dummy battery 55 as shown.

Respective contact blades 56 are adjacent the roofs of the battery compartments 42 to contact a battery terminal of a battery 20 in the compartment. An insulated wire 58 extends from each contact blade 56 and is connected to a rotary switch assembly 60 located outside the watch movement 14 but within the movement compartment 44. Each wire 58 extends through a respective through-bore 62 in the wall of the battery compartment 42 to reach the switch assembly 60. See FIG. 8. Each bore 62 is preferably sealed with a gasket 64 to maintain the integrity of the battery compartments. Alternatively, each wire 58 could connect to the portion of the contact blade 54 outside of the battery compartment and not extend through the battery compartment wall. Four insulated wires 66 extend from the switch assembly 60 to the contact blade 54. Each wire 66 is associated with a respective battery compartment 42.

The switch assembly 60 includes a fixed rectangular, insulated contact plate 68 held in a cutout formed in the side of the watch compartment. An operating shaft 70 extends from the switch crown 22 and is rotatably mounted in the watch casing. A reduced diameter portion of the shaft 70 extends through the center of the contact plate 68 and forms a shoulder that prevents axial movement of the shaft 70 towards the watch movement. A reduced diameter portion of the shaft 70 adjacent the switch crown 22 cooperates with an external set screw 72 to prevent axial movement of the shaft 70 to or away from the watch movement. See FIG. 8.

An insulated switch plate 74 is nonrotatably carried on the reduced diameter portion of the shaft 70 and faces the contact plate 68. The switch plate 74 is free to move or slide axially along the reduced diameter portion of the shaft 70 and is urged towards the contact plate 68 by a compression spring 76 friction clipped to the end of the shaft 70. Pairs of raised metal contacts 78*a*, 78*b*, 78*c* and 78*d* are carried on the contact plate 68 facing the switch plate 74. The contact pairs 78 are circumferentially spaced ninety degrees from each other about the shaft 70. The switch plate 74 carries a jewel wheel 80 on one end of the plate and a like diameter metal wheel 82 on the other end of the plate.

Each battery wire 58 is connected to one side of a respective pair of contacts 78. Each wire 66 is connected to the other side of the respective pair of contacts 78. See FIG. 2 (for clarity the wires 58, 66 are not shown in FIGS. 5 and 9–12). Each set of wires 58, 66 forms a portion of an electric circuit between a respective battery compartment contact blade 56 and the contact blade 54. The gap between the contacts of each contact pair 78 causes the electrical circuits to be normally open such that each battery 20 is not electrically connected to the watch movement 14 unless the gap is closed by the switch plate 74.

The switch plate 74 is centered on the shaft 70 such that the jewel wheel 80 and metal wheel 82 will successively engage and contact opposed pairs of contacts 78 by rotating the shaft 70. The metal wheel 82 electrically jumps and connects the engaged pair of contacts to close one of the circuits between a contact blade 56 and the contact blade 54. The compression spring 76 urges the metal wheel 82 against the pair of contacts 78 to assure a dependable electrical connection is made.

The jewel wheel 80 is an insulator and does not electrically jump the engaged pair of contacts 78. The jewel wheel 80 thereby maintains the open circuit between contact blade 56 and the contact blade 54 associated with the pair of contacts engaged by the jewel wheel 80.

Figure 12:
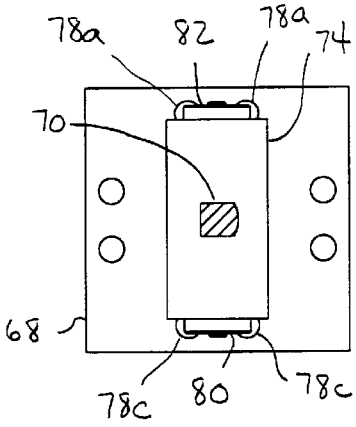
FIG. 12 is a sectional view taken along line 12—12 of FIG. 5.

Operation of the switch assembly 60 will now be described. Fresh batteries 20 are initially placed in each of the battery compartments 42. One terminal of each battery 20 engages a contact blade 56 and the other battery terminal engages the lower case element 30 forming the floor of the battery compartment. The rotary switch 60 is initially positioned as shown in FIG. 12, with the switch crown 22 positioned as shown in FIG. 7. The switch crown 22 preferably includes indicia, such as the arrow shown, to provide visual feedback to the user of the angular position of the crown 22. Indicia could also be included on the outside of the watchcase 12 if desired.

The metal wheel 82 acts as a jumper electrically connecting the pair of contacts 78*a*, thereby electrically connecting the battery 20*a* with the watch movement 14. The other batteries 20*b*, 20*c* and 20*d* are electrically disconnected from the watch movement 14. The battery 20*a* is now the sole power source energizing the watch movement 14 for normal operation of the watch.

After the battery 20*a* is exhausted, the user rotates the switch crown 22 ninety degrees to disconnect the exhausted battery 20*a* and connect a fresh battery 20*b* to the watch movement 14. The switch plate 74 rotates with the switch crown 22. The metal wheel 82 travels from the contact pair 78*a* to the contact pair 78*b*. The jewel wheel 80 travels from the contact pair 78*c* to the contact pair 78*d*. After the switch crown 22 rotates ninety degrees the battery 20*b* is electrically connected via the contact pair 78*b* and the metal wheel 82 to the watch movement 14.

The user successively rotates the switch crown 22 ninety degrees to connect a fresh battery 20*c* and then a fresh battery 20*d* to the watch movement 14. When all four batteries 20 are exhausted, the batteries 20 are replaced with fresh batteries. The user may instead prefer to replace exhausted batteries after only three batteries are exhausted to ensure the watch is never without a reserve battery.

Figure 9:
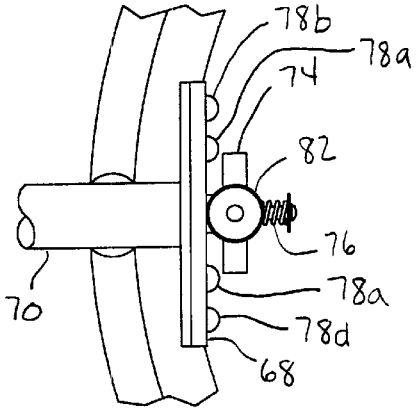
FIG. 9 is an enlarged top view of a portion of the rotary switch assembly shown in FIG. 5, the switch in a first operating position.
Figure 10:
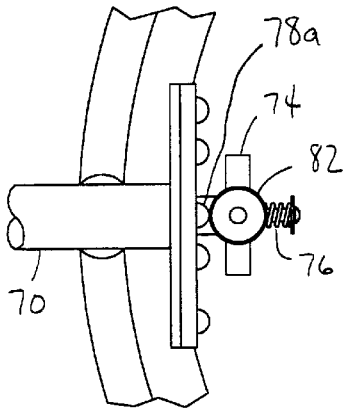
FIG. 10 is a view similar to FIG. 9 but with the switch in a second operating position.
Figure 11:
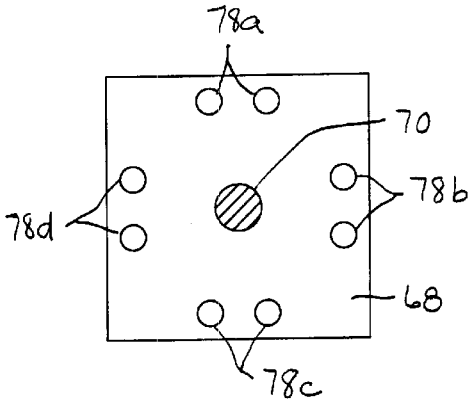
FIG. 11 is a sectional view taken along line 11—11 of FIG. 5.

The rotary switch 60 provides tactile feedback as the user is rotating the switch crown 22. For example, FIG. 9 illustrates the metal wheel 82 engaged with the contact pair 78*a*. When switching from battery 20*a* to 20*b*, the metal wheel 82 rides up and over one of the contacts of the departing contact pair 78*a* and then rides up and over one of the contacts of the arriving contact pair 78*b*. The jewel wheel 80 similar rides up and over one of the contacts of the departing contact pair 78*c* and then rides up and over one of the contacts of the arriving contact pair 78*d*. The wheels 80, 82 push the switch plate 84 towards the free end of the shaft 70, compressing the spring 74. FIG. 10 illustrates the metal wheel 82 on the top of one of the contacts 78*a* with the spring 74 compressed. The wheels 80, 82 act on opposite ends of the switch plate 74 so that the switch plate 74 slides without binding. After the wheels 80, 82 have passed over the contact, the spring 74 urges the switch plate 74 towards the contact plate 68. The spring 74 elongates and relieves the resistance to rotation of the shaft 70.

When rotating the switch crown 22 to switch from one battery to another, the user experiences a first resistance to rotation as the wheels 80,82 leave one pair of contacts 78 and then a second resistance to rotation as the wheels 80, 82 arrive at the next pair of contacts 78. The initial resistance also resists inadvertent rotation of the switch crown 22 from its set position from external forces. The second resistance indicates the switch crown 22 is reaching its next intended operating position. The subsequent decrease in resistance indicates the wheels 80, 82 have reached their intended position engaged between the next pair of contacts 78.

As described above, indicia such as the arrow on the crown provides additional verification that the switch crown 22 has reached its intended position. Further verification is provided by the second hand only moving when the crown stem is positioned properly. The switch crown 22 may be rotated in either direction, clockwise or counter-clockwise, when changing from one battery to another.

The wristwatch 10 provides about four times the normal operating life of a conventional wristwatch powered by a single battery. The battery compartments are completely enclosed by the compartment walls, floor and bottom when the battery doors are closed. The batteries can be replaced without exposing the watch movement to the outside environment. The illustrated embodiment uses a mechanical switch to enable the user to operatively switch between batteries. Other embodiments of the present invention can include electronic circuitry to detect a low battery condition and automatically switch from the low battery to a charged battery.

In yet other possible embodiments of the present invention the lower case member can be made from a nonconductive or insulating material. Being nonconductive, the lower case member cannot form a portion of the electrical connections between the battery compartments and the watch movement. In such embodiments wires or metal plates can extend from the watch movement to the battery compartments to form a portion of the electrical connections.

In further possible embodiments of the present invention the batteries can be connected in parallel to simultaneously energize the watch movement, and can include a battery in the watch movement battery compartment. The batteries flow current simultaneously to power the watch movement. In yet other embodiments of the present invention one or more batteries can provide power to an auxiliary device such as, for example, a lamp to illuminate the time display.

In other possible embodiments of the present invention a watch movement can drive a digital display or combined analog/digital display, with the means for displaying the time modified accordingly. The display of time can include the day, date or other time-related data.

The illustrated watch movement 14 has only one watch control to operate the watch movement and displays the time only. In still other possible embodiments of the present invention, conventional watch movements having additional watch controls can be used. These controls typically operate additional watch movement functions, such as a stopwatch, interval timer or the like. The display for indicating the time can incorporate additional displays associated with the additional functions.

The dummy battery 55 is configured to enable use of a conventional watch movement having a battery compartment to be used in accordance with the present invention. In other possible embodiments the watch movement can be specifically configured for use with multiple batteries in accordance with the present invention. Such watch movements can, for example, eliminate the battery compartment and incorporate terminals for electrically connecting the external batteries to the drive mechanism.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A wristwatch comprising:

a rigid watchcase extending between a pair of opposite ends, the watchcase defining an interior case compartment, a watch movement within the case compartment, and means for displaying the time operatively connected to the watch movement;

the watchcase defining a first pair of battery compartments in the case compartment adjacent one end of the watchcase and a second pair of battery compartments in the case compartment adjacent the other end of the watchcase, each battery compartment being configured to retain a battery for powering the watch movement;

electrical connections in the case compartment extending from each battery compartment to the watch movement to transmit electrical power from a battery in the battery compartment to the watch movement when a battery is in the battery compartment;

a pair of spaced apart lugs extending from each end of the watchcase, each pair of lugs configured to mount an end of a watchband to the watchcase; and each lug movably mounted on the exterior of the watchcase adjacent a respective battery compartment, the lug forming a battery compartment door and movable between a first position wherein the respective battery compartment is open for insertion or removal of a battery from the battery compartment and a second position wherein the respective battery compartment is closed to retain the battery in the battery compartment.

2. A wristwatch comprising:

a rigid watchcase comprising an exterior portion defining an interior case compartment, a battery-powered watch movement within the case compartment, and means for indicating the time operatively connected to the watch movement;

the watchcase defining a watch movement compartment and at least two battery compartments in the case compartment, each battery compartment configured to retain at least one battery in the battery compartment, the watch movement in the watch movement compartment and outside of the battery compartments; and electrical connections in the watchcase and extending from each battery compartment to the watch movement to transmit electrical power from a battery in the battery compartment to the watch movement when a battery is in the battery compartment, the electrical connections comprising means for selectively switching between each of the battery compartments so that only the battery or batteries in the selected battery compartment are electrically connected to the watch movement during normal operation of the wristwatch, the means for switching comprising a mechanical switch and a crown extending out of the watchcase to mechanically operate the switch.

3. A wristwatch having selectable and redundant power sources, the wristwatch comprising:

a rigid watchcase comprising an exterior portion defining an interior and a battery-powered watch movement within the interior, the watch movement comprising means for indicating the time;

the watchcase defining at least two battery compartments in the interior of the watchcase, each battery compartment configured to retain a power source independently capable of operating the watch movement to indicate the time, each power source comprising at least one battery;

electrical connections in the watchcase extending from each battery compartment to the watch movement to transmit electrical power from each power source to the watch movement;

the electrical connections comprising a switch mechanism operatively connected between the power sources and the watch movement to selectively electrically connect a power source to the watch movement and electrically disconnect all the other power sources from the watch movement so that only one power source is electrically connected to the watch movement during normal operation of the watch movement; and the switch mechanism being actuatable to disconnect the connected power source from the watch movement and connect one of the one or more disconnected power sources to the watch movement whereby power sources may be successively connected to the watch movement to extend the normal operating life of the wristwatch as compared to a conventional wristwatch having a single power source.

4. The wristwatch of claim 3 wherein the switch mechanism comprises a mechanical switch mechanism or an electronic switch mechanism.

5. The wristwatch of claim 4 wherein the switch mechanism is a mechanical switch mechanism;

the electrical connections comprise sets of contacts, each contact set associated with a respective battery compartment; and the switch mechanism comprises a contact member engageable with each contact set to electrically connect the power source in the battery compartment associated with the engaged contact set with the watch movement.

6. The wristwatch of claim 5 wherein the contact member is a contact wheel rollable between contact sets.

7. The wristwatch of claim 3 wherein the switch mechanism comprises a control stem that extends outwardly from the watchcase to enable a wearer to switch among power sources.

8. The wristwatch of claim 3 wherein the exterior portion of the watchcase comprises a plurality of battery compartment doors, each door associated with a respective battery compartment to open and close the battery compartment for inserting or removing a battery or batteries from the respective battery compartment.

9. The wristwatch of claim 8 wherein each battery compartment is enclosed by an interior wall when the door associated with the battery compartment is closed, each battery compartment closed off from the other battery compartments whereby opening a battery compartment door exposes only the battery compartment associated with the door to the outside environment.

10. The wristwatch of claim 3 wherein the electrical connections include an integral member forming a conduction path to electrically interconnect power supplies in the battery compartments.

11. The wristwatch of claim 3 wherein the watchcase comprises the integral member.

12. The wristwatch of claim 3 wherein the watch movement comprises and defines an additional battery compartment, the watch movement capable of being powered solely by one or more batteries in the additional battery compartment, and the electrical connections comprise a dummy battery or batteries in the additional battery compartment.

13. A battery-powered wristwatch comprising:

a rigid watchcase defining an interior compartment, a battery-powered watch movement within the watchcase compartment, the watch movement comprising means for indicating the time, and electrical connections in the watchcase to transmit electrical power from a battery to the watch movement;

the watchcase comprising a battery opening, a door for opening and closing the battery opening, and a door hinge mounting the door to the watchcase, the door hinge defining a pivot axis; and the battery opening communicating the ambient environment outside the watchcase with the interior compartment for inserting or removing a battery from the watchcase, the door pivotable about the pivot axis between opened and closed positions to open and close the battery opening, wherein the door is mounted to the watchcase by the door hinge in all door positions.

14. The wristwatch of claim 13 wherein the exterior of the watchcase comprises opposed upper and lower surfaces and edges joining the upper and lower surfaces; and the battery opening is entirely located on at least one of the edges of the watchcase, whereby the battery opening does not disturb the integrity of either the upper and lower watchcase surfaces.

15. The wristwatch of claim 13 wherein the watchcase includes a wall defining and surrounding a battery compartment for retaining a battery in the watchcase when the door is closed, the door comprising a surface forming at least a portion of the wall, whereby opening the door exposes only the battery compartment and not the remaining interior volume of the watchcase to the ambient environment.

16. The wristwatch of claim 13 wherein the door comprises a handle extending outwardly away from the remainder of the watchcase.

17. The wristwatch of claim 16 wherein the handle comprises a lug configured for attaching a watchband to the watchcase.

18. The wristwatch of claim 13 comprising means for retaining the door in the closed position.

19. The wristwatch of claim 13 wherein the battery opening is a first battery opening and the watchcase further comprises at least one additional battery opening, each additional battery opening associated with a respective additional door and additional door hinge mounting for opening and closing the additional battery opening.

20. The wristwatch of claim 13 wherein the door hinge comprises a hinge pin that defines the axis.

* * * * *